US010184249B2

(12) United States Patent
Mountfort et al.

(10) Patent No.: US 10,184,249 B2
(45) Date of Patent: Jan. 22, 2019

(54) EXPANDING PANEL AND METHOD OF MANUFACTURE

(71) Applicant: AUTEX INDUSTRIES LIMITED, Auckland (NZ)

(72) Inventors: Jonathan Seymour Mountfort, Auckland (NZ); Luke Clifford Walker, Auckland (NZ)

(73) Assignee: AUTEX INDUSTRIES LIMITED, Auckland (NZ)

( * ) Notice: Subject to any disclaimer, the term of this patent is extended or adjusted under 35 U.S.C. 154(b) by 56 days.

(21) Appl. No.: 15/386,635

(22) Filed: Dec. 21, 2016

(65) Prior Publication Data

US 2017/0175390 A1 Jun. 22, 2017

(30) Foreign Application Priority Data

Dec. 21, 2015 (NZ) ..... 715421

(51) Int. Cl.

| | |
|---|---|
| ***E04C 2/40*** | (2006.01) |
| ***B44C 5/04*** | (2006.01) |
| ***E04F 13/072*** | (2006.01) |
| ***E04F 13/075*** | (2006.01) |
| ***E04F 13/076*** | (2006.01) |
| ***E04F 13/08*** | (2006.01) |
| ***E04F 13/12*** | (2006.01) |
| ***E04F 13/18*** | (2006.01) |
| ***E04C 2/08*** | (2006.01) |

(Continued)

(52) U.S. Cl.

CPC ..... *E04C 2/405* (2013.01); *B44C 5/0461* (2013.01); *E04C 2/08* (2013.01); *E04C 2/20* (2013.01); *E04F 13/072* (2013.01); *E04F 13/075* (2013.01); *E04F 13/076* (2013.01); *E04F 13/0871* (2013.01); *E04F 13/12* (2013.01); *E04F 13/18* (2013.01); *E04B 1/99* (2013.01)

(58) Field of Classification Search

CPC ... E04C 2/405; E04C 2/08; E04C 2/20; B44C 5/0461; E04F 13/075; E04F 13/072; E04F 13/076

See application file for complete search history.

(56) References Cited

U.S. PATENT DOCUMENTS 4,327,516 A * 5/1982 Lubozynski ..... A63H 33/16 428/12
4,780,344 A * 10/1988 Hoberman ..... E04C 2/40 428/12

(Continued)

*Primary Examiner* — Paola Agudelo
(74) *Attorney, Agent, or Firm* — Young & Thompson

(57) ABSTRACT

An expandable panel, constructed such that the expandable panel can at least expand in at least one direction, includes a panel having a front face and rear face bordered by side edges, end edges and a thickness dimension extending between the front and rear faces and includes discretely spaced cuts extending from the front face to the rear face or rear to front face. The cuts form bridging members between living hinges and are elongate and extend in a spaced longitudinal manner including at least one cut forming a side of the expandable panel located on one side of the cut, and at least two cuts located on a side of the expandable panel. The at least one cut on side and the other cuts on side together forming at least one pair of lines being substantially parallel, offset mirror images of each other and being intermeshed but not touching.

20 Claims, 11 Drawing Sheets

(51) Int. Cl.
*E04C 2/20* (2006.01)
*E04B 1/99* (2006.01)

(56) References Cited

U.S. PATENT DOCUMENTS

| | | | | |
|---|---|---|---|---|
| 5,234,727 | A * | 8/1993 | Hoberman | A63H 33/16 428/12 |
| 6,054,194 | A * | 4/2000 | Kane | B60D 5/003 105/18 |
| 9,742,348 | B2 * | 8/2017 | Francis | H02S 30/20 |
| 2007/0256387 | A1 * | 11/2007 | Dorsy | E04C 2/08 52/588.1 |
| 2009/0064601 | A1 * | 3/2009 | Kroes | E04C 2/405 52/108 |
| 2009/0320898 | A1 * | 12/2009 | Gumm | H02S 30/20 136/245 |
| 2010/0218363 | A1 * | 9/2010 | Zahner, III | E04C 2/08 29/527.4 |
| 2013/0285595 | A1 * | 10/2013 | Eaton, Jr. | H01L 31/042 320/101 |
| 2015/0140253 | A1 * | 5/2015 | Lang | F24J 2/36 428/57 |
| 2016/0010331 | A1 * | 1/2016 | Milanowski | E04C 2/405 52/581 |
| 2016/0129299 | A1 * | 5/2016 | Newman | A63B 21/4037 482/142 |

* cited by examiner

EXPANDING PANEL AND METHOD OF MANUFACTURE

The invention relates to an expanding or expandable panel and method of manufacture. The invention is directed particularly but not solely towards a shaped expandable panel for use in certain designs and acoustic solutions.

BACKGROUND OF INVENTION

Shaping and forming decorative panels to create an artistic solution to an architectural requirement is very difficult to achieve. This means that the panel is required to bend and form a certain shape without distortion and be stable enough to remain in place.

Many such certain shapes are complicated and difficult to achieve as a method of manufacture without damaging the panel. Additionally existing panels have a structure that does not appear to enable existing manufacturing methods to work properly or quickly which can mean attempting to form the panel in the certain shape rather than allowing the shape to be created just when it is required to be installed. Existing methods of manufacture of a curved or shaped panel can cause significant material wastage. Therefore only limited shapes are possible making any manufacturing complicated and expensive to carryout.

Furthermore some manufacturing methods can cause the panel to expand in more than direction (length and width), causing more distortion to the panel shape. Additionally existing methods only include one way expansion ie stretching or pulling into shape, like for mesh which entails all of the problems of transporting and handler are much larger item. Metal mesh is perforated and forcibly stretched, permanently deforming the metal along its natural bending plane resulting in a non-planar surface.

Therefore storing and transporting shaped panels or mesh can be costly as the shape can take up much more space or volume than a traditional flat panel requiring more transport and greater areas for storage. Handling a shaped panel or mesh can also be difficult and time consuming.

In this specification unless the contrary is expressly stated, where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

OBJECT OF THE INVENTION

It is an object of the invention to provide an expanding panel or expandable panel and method of manufacture that ameliorates some of the disadvantages and limitations of the known art or at least provide the public with a useful choice.

SUMMARY OF INVENTION

In a first aspect, the invention resides in an expandable panel which is constructed such that the expandable panel can at least expand in at least one direction, comprising a panel having a front face 2 and rear face 5 bordered by side edges 3, end edges 4 and a thickness dimension 15 extending between the front and rear faces and discrete cuts 6 extending from the front face to the rear face or rear to front face, the cuts 6 forming bridging members 35 between living hinges 8, the cuts 6 having cut side faces 16 there between, wherein the cuts 6 are elongate and extend in a spaced longitudinal manner comprising at least one cut 6 forming a side 23 of the expandable panel 1 located on one side of the cut 6, and at least two cuts 6 located on a side 24 of the expandable panel 1, the at least one cut 6 on side 23 and the other cuts 6 on side 24 together forming at least one pair of lines being substantially parallel, offset mirror images of each other and being intermeshed but not touching, a distance between the end edges 4 defining a length in a longitudinal direction 18 and a distance between side edges 3 defining a width in a transverse direction 19 cuts 6 are oriented in the longitudinal direction 18 and each cut 6 comprises at least a base portion 30 and end portion 31 wherein the end portion 31 extends at an angle with respect to the base portion 30 forming a recess 32 there between, with the base portion 30 being oriented in one of the cuts 6 and the end portion 31 extending an acute angle with respect to the line of the base portion 30 such that the cut 6 is adjacent the other cuts 6 and the recesses 32 of both cuts 6 face each other forming movable bridging members 35 between the living hinges 8 which allow the expandable panel to optionally exist in an expanded state and in a retracted state where the sides 23, 24 of the expandable panel can be pulled transversely apart to expand the expandable panel such that the bridging members 35 are twisted and rotated about the living hinges 8 forming at least one expandable panel space aperture 10 between the cuts 6 on one side of one bridging member 35 and at least two apertures 10 on the other side of two bridging members 35, such that the width or length of the expandable panel is able to be increased or decreased transverse to a length of the cuts 6 wherein the states are stable states such that the expandable panel pops into each state as required wherein expansion or retraction of the expandable panel is caused by rotation of at least two bridging members 35 about at least four living hinges 8 which include an inner pair of living hinges 8*a* and an outer pair of living hinges 8*b*, which such rotation causes the inner pair of living hinges 8*a* to at least move and rotate and the outer pair of living hinges 8*b* rotates only by staying in one position and vice versa whereby each bridging member 35 rotates about the outer pair of living hinges 8*b* while one side 24 or 23 of the expandable panel moves laterally away from the other side 23 or 24.

Preferably each bridging member 35 spans between the sides of the expandable panel between the cuts 6 on each side, thereby providing one aperture 10 on one side of the bridging members 35 and two apertures 10 on the other side of the bridging members 35 and each bridging member 35 rotates about the living hinges 8, (eg approximately 90 degrees) when the expandable panel is expanded wherein the apertures 10 increase in area to a maximum when the expandable panel is expanded.

Preferably a first longitudinal line of cuts 20 is formed by at least two cuts 6 in a line spaced from one another and a second longitudinal line of cuts 21 is formed by the other cuts 6 comprising at least one pair of cuts 6 in a line spaced from one another wherein the expandable panel is also able to retract in the same manner as for expanding but in the opposite direction whereby the areas of the apertures 10 are minimized Preferably the direction of at least the expansion is dependent on the orientation of the cuts 6 which such direction is oriented at right angles to the length of the cuts 6 and which means the direction of expansion and retraction is directed towards the sides or ends of the expandable panel.

Preferably at least one length or width dimension of the expandable panel is not changed when the expandable panel is expanded.

Preferably, the cut 6 at the end edge 4 of the longitudinal cut line 20 or 21 of the expandable panel is formed of a different shape to the cut 6, not at the end edge 4 of the expandable panel wherein the cut 6 at the end edge 4 of the longitudinal cut lines 20, 21 is half the length of the cuts 6 not at the end of the longitudinal cut lines 20, 21.

Preferably, the cut 6 at the end of a longitudinal cut line 20, 21 of the expandable panel is L shaped and the cut not in the middle of the panel, is square U shaped whereby an upright portion of the L forms the base portion and a base of the U shape is the base portion 30 which are oriented in a line forming one longitudinal cut line 20 or 21.

Preferably, the end portion 31 of one cut 6 is an end portion which includes a shape comprising distal end distal to the base portion 30, wherein the distal end of the end portion 31 of the first longitudinal cut line 20 is transversely closer to the base portion 30 of the second longitudinal cut line 21 than a transverse distance between the end portion 31 of the first longitudinal cut line 20 to the end portion 31 of the second longitudinal cut line 21 wherein the cuts 6 of each longitudinal line of cuts are closer to each other rather than the distance between pairs of longitudinal line of cuts 20, 21.

Preferably a driving geometry of the expandable panel to enable extension and retraction, is the relationship between a length of one joint L as defined as angled distance from a distal end of the end portion of one cut 6 in one longitudinal cut line 20 to a distal end of an end portion 31 of another cut 6 in the other longitudinal cut line 21) forming a distance between the living hinges 8 and an included angle (A) which relates to the angle of rotation of each bridging member 35.

Preferably, each expandable panel has stable states which include two natural states of equilibrium, open or expanded and closed or retracted, wherein each cut 6 forms a hinge or joint that resists existing in any other state as the joint will tolerate compression required to change between the states, but will act like a spring by 'popping' the expandable panel open or closed wherein each cut 6 resists the expandable panel existing in any other state as the joint will tolerate the compression required to change between states, but will essentially act as a spring 'popping' the expandable panel section open forming each aperture 10 or closed with no aperture 10.

Preferably each living hinge 8 is located between an end of one cut 6 of one longitudinal cut line 20 and a base portion 30 of the adjacent cut 6 of the other longitudinal cut line 21, whereby when two living hinges 8 are located at opposite sides of the longitudinal cut lines 20, 21 then one bridging member 35 is formed there between which is able to rotate by angle A when the expandable panel is expanded or retracted.

Preferably, a longitudinal distance 26 as defined from end edges 4 from the distal end of one end portion 31 in the first longitudinal cut line 20 or 21 to the adjacent distal end of the another end portion 31 in the same first longitudinal cut line 20 or 21 is greater than the transverse distance 33 between from the distal end of the end portion of the first line 20 to the base portion 30 of the cuts 6 of the second longitudinal cut line 21.

Preferably, the transverse distance 33 as defined between side edges 3, between the distal end of the end portion of a cut in the first or second longitudinal cut line 20 or 21, to the base portion 30 of the cut in the second longitudinal cut line 21 or 20, forms one living hinge 8.

Preferably, the bridging portion 35 is diamond shaped.

Alternatively the bridging portion 35 is oval shaped.

Alternatively the bridging portion 35 is rectangular shaped.

Preferably each cut 6 comprises an angled shape or curved shape and can be selected from the following shapes of U shaped or splayed U shape, S shaped or Z shaped in any combination.

Preferably the first longitudinal cut line 20 is closer to the second longitudinal cut line 21 (ie distance 28) than the second longitudinal cut line 21 is to an adjacent third longitudinal cut line (ie distance 25) wherein longitudinal cut line 20 which faces longitudinal cut line 21 with spaced cuts 6, which intermesh with each other without touching.

Alternatively the first longitudinal cut line 20 is not closer to the second longitudinal cut line 21 (ie distance 28) than the second longitudinal cut line 21 is to an adjacent third longitudinal cut line (ie distance 25) wherein longitudinal cut line 20 which faces longitudinal cut line 21 with spaced cuts 6, which intermesh with each other without touching.

Preferably the first and second longitudinal cut lines 20, 21 include spaced straight lines. Alternatively the first and second longitudinal cut lines 20, 21 include spaced angled lines. Alternatively the first and second longitudinal cut lines 20, 21 include spaced or combined straight and angled lines.

Alternatively the first and second longitudinal cut lines 20, 21 include spaced curved lines. Preferably there are a plurality of spaced cuts 6 in each longitudinal cut line.

Preferably when the expandable panel is expanded, the area of the aperture 10 is larger than the area of the bridging member 35.

Preferably each aperture 10 is boat shaped with straight and angled cut lines.

Preferably each aperture 10 is boat shaped with curved cut lines.

Preferably the apertures 10 on one side of the bridging members 35 are similar in area than the apertures on other side of the bridging members.

Preferably the apertures 10 on one side of the bridging members 35 are larger in area than the apertures 10 on other side of the bridging members 35.

Preferably the apertures 10 on one side of the bridging members 35 are different in shape to the apertures 10 on other side of the bridging members 35.

Preferably during expansion each bridging member 35 has a body that rotates having a major portion of that body which rotates about a horizontal plane ie same plane as the faces of the panel, with a smaller portion of the body rotating vertically if needed or able to.

Preferably each living hinge 8 is defined and formed by a transverse distance 33 located between the end of one cut 6 on one longitudinal cut line 20 extending to the base portion 30 of a cut 6 of the second longitudinal cut line 21, and a longitudinal distance 26 as defined between an end of the end portion 30 of cuts 6 in one longitudinal cut line 20 or 21 wherein the transverse distance 33 is less than the longitudinal distance 26.

Preferably each bridging member 35 has a diagonal distance L extending between living hinges 8 which is proportional to a rotation angle A of the bridging member 35.

Preferably when the panel is expanded the bridging member 35 rotates about the living hinges 8 forcing abutting side walls 16 to move from almost abutting relationship (ie minimized aperture 10 at almost zero area) to a spaced relationship forming apertures 10 there between which will extend to a maximum area. When retracting or closing the panels the same thing occurs but in reverse with the area of apertures 10 decreasing in area to nothing or almost nothing.

In a second aspect, the invention resides in an expandable panel comprising a expandable panel having a front face 2 and rear face 5 bordered by side edges 3, end edges 4 and a thickness dimension 15 extending between the front and rear faces and cuts 6 extending from the front face to the rear face or rear to front face, the cuts 6 forming bridging members 35 between living hinges 8, the cuts 6 having cut side faces 16 there between forming apertures 10 there between, wherein the apertures 16 are discrete areas and extend in a spaced manner in a curved or angled first longitudinal line of cuts 20 and in at least in a second curved or angled longitudinal line of cuts 21 forming a side 23 of the expandable panel on one side of the longitudinal line of cuts, and a side 24 on the other side, a distance between the end edges 4 defining a length in a longitudinal direction 18 and a distance between side edges 3 defining a width in a transverse direction 19 whereby the first and second longitudinal line of cuts s are oriented in the longitudinal direction 18 and each cut 6 comprises at least a base portion 30 and end portion 31 wherein the end portion 31 extends at an angle with respect to the base portion 30 forming a recess 32 there between, with the base portion 30 being oriented in one of the longitudinal line of cuts s and the end portion 31 extending an acute angle with respect to the line of the base portion 30 such that the first longitudinal line of cuts 20 is adjacent the second longitudinal line of cuts 21 and the recesses 32 of both longitudinal cut lines 20, 21 face each other forming bridging members 35 between the living hinges 8 which allow the expandable panel to exist in the expanded state where the sides 23, 24 of the expandable panel were pulled transversely apart to expand the expandable panel such that the each aperture 16 is located between the living hinges 8 of both longitudinal cut lines 20, 21.

In a third aspect the invention resides in a method of manufacturing an expandable panel as disclosed in this specification, including

- Provide expandable panel made of a material able to form living hinges;
- Position in cutting apparatus or manufacturing apparatus including cutting and moulding;
- Cut in specific pattern to form pairs of longitudinal cut lines with bridging members between living hinges.

To those skilled in the art to which the invention relates, many changes in construction and widely differing embodiments and application of the invention will suggest themselves without departing from the scope of the invention as defined in the appended claims. The disclosures and the descriptions herein are purely illustrative and are not intended to be limiting.

BRIEF DESCRIPTION

The invention will now be described, by way of example only, by reference to the accompanying drawings:

FIG. 1 is a plan view of one of the simplest forms of the expandable panel of the present invention in a retracted mode or state.

FIG. 2 is a plan view of one of the simplest forms of the expandable panel of the present invention in an expanded state.

FIG. 3 is a schematic front view of the expandable panel in accordance with a first preferred embodiment of the invention which is in a retracted mode or state.

FIG. 4 is a schematic front view of the expandable panel in accordance with a first preferred embodiment of the invention which is in an expanded mode or state.

FIG. 5 is a perspective view of the expandable panel in a retracted mode or state.

FIG. 6 is a top plan view of an expandable panel in an expanded mode with diamond shaped twisting body with straight cut lines and polygonal apertures.

FIG. 7 is top plan view of the expanded panel of FIG. 6 in a closed or retracted state.

FIG. 8 is a top plan view of an expandable panel in an expanded mode with diamond shaped bridging member and polygonal shaped aperture in angled cut lines.

FIG. 9 is a top plan view of the expanded panel of FIG. 8 in a closed or retracted state.

FIG. 10 is a top plan view of an expandable panel in an expanded mode with curved diamond shaped bridging member and curved three sided apertures.

FIG. 11 is a top plan view of an expanded panel with curved cut lines in a closed or retracted state.

FIG. 12 is a top plan view of a half circle offset cut lines panel firstly in a closed or retracted state and then in an expanded or open state.

FIG. 13 is a top plan view of boat shaped cut lines panel firstly in a closed or retracted state and then in an expanded or open state.

FIG. 14 is a top plan view of a half circle cut lines panel firstly in a closed or retracted state and then in an expanded or open state.

FIG. 15 is a top plan view of a square U shaped cut lines panel firstly in a closed or retracted state and then in an expanded or open state.

FIG. 16 is a top plan view of a round U shaped cut lines panel firstly in a closed or retracted state and then in an expanded or open state.

DESCRIPTION OF DRAWINGS

The following description will describe the invention in relation to preferred embodiments of the invention, namely an expandable panel 1 or in a further option, expanding and/or retracting panel 1 and method of manufacture, as shown in FIGS. 1-16. The invention is in no way limited to these preferred embodiments as they are purely to exemplify the invention only and that possible variations and modifications would be readily apparent without departing from the scope of the invention.

The expandable panel 1 of the present invention includes a sheet of material or panel, cut in such a way that it can be at least pulled and expanded or opened over one direction like for example over its width (side to side) in one state in one stable equilibrium, without sacrificing one direction eg its width. In another option the expandable panel can be retracted or closed in another state in another stable equilibrium. Both states are stable and separate whereby the expandable panel 1 is moved to pop or spring into each state. Once expanded, the original sheet can be for example up to 1.5 times its original length in whatever panel direction required but in at least one direction (eg width and/or length), be flexible and semi-transparent. By experimenting with the geometry of the cut 6, the expanded sheet can remain flat or curved along a two dimensional plane, or made to deform in a 3 dimensional sense to create a greater volume.

Figure 1:
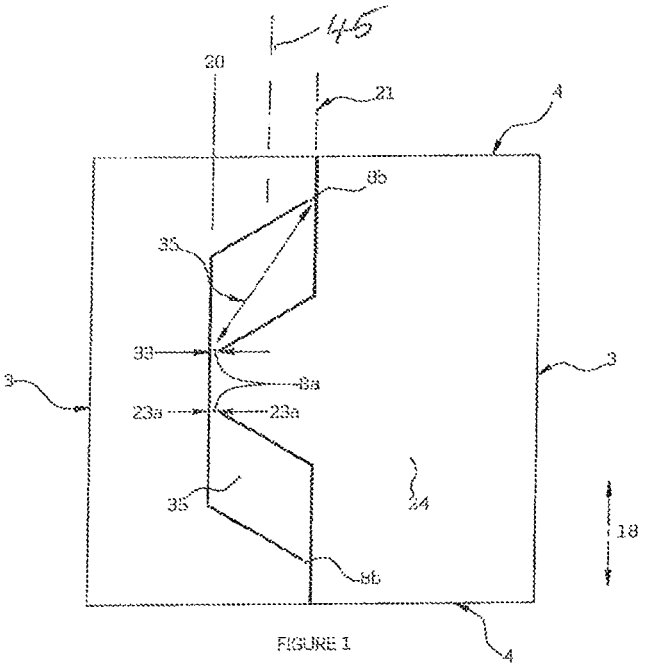

The present invention cuts processing work by exploiting the unique material characteristics of a sheet or panel product with specially shaped and positioned cuts therein, which together for such panels are flexible or ductile in some sections or portions, and are made to act to hingedly deform and/or at least rotate when being expanded about various living hinges. This allows a sheet or panel to be cut in certain positions and at least be expanded, opened or stretched so that one show face remains the show face with no twisting or permanent deformation of the material of the panel which allows certain portions to be hinged about living hinges in at least one plane to create an apertured panel.

The figures show expandable panel 1 having a front face 2, side edges 3, end edges 4, a rear face 5 (not seen) at least one cut 6, at least one living hinge 8 and at least one aperture 10. In this example, the front face 2, rear face 5, side edges 3 and end edges 4 can be planar in surface shape.

As shown in the figures each cut 6 extends between the front face 2 and rear face 5 forms a depth 15 with cut side faces 16. Each cut 6 is generally elongate in extent forming a longitudinal direction 18 along the expandable panel 1 and a transverse or lateral direction 19 oriented at right angles or perpendicular to the longitudinal direction 18.

In this example, if the expandable panel 1 is oriented with the front and rear faces 2, 5 in a horizontal plane, the side edges 3 and/or end edges 4 are said to be oriented in a substantially vertical plane and the cut side faces 16 can also be substantially in a vertical plane. The longitudinal direction 18 of each cut 6 is elongate and is oriented in a direction substantially parallel with the side edges 3 of the expandable panel 1 but not necessarily entirely in the parallel direction.

Minimally there is at least one cut 6 forming one line forming one side 23 of the panel and immediately adjacent, there is at two cuts 6 oriented but spaced end to end from one another on another in line forming a side 24 of the panel, whereby the at least one cut 6 on one side 23 is spaced from the in line cuts 6 on the other side 24 forming a pair of lines. The lines on each side are shaped to intermesh with other without touching.

As shown in the figures (whether the expandable panel 1 is open or closed) there can be at least two or at least one pair of, longitudinal cut lines forming two line patterns ie a first longitudinal cut line 20 and a second longitudinal line of cuts 21 of cuts oriented parallel with axis 18 but being a offset mirror image of each other and extending from one end edge 4 to the other or alternatively, from one side edge 3 to the other. Each longitudinal line of cuts 20 and 21 comprise spaced cuts 6. Each cut 6 of each longitudinal line of cuts 20 and 21 have a portion which almost meet, intersect or intermesh to form the living hinge 8 (ie the narrowest portion) there between. As seen in FIG. 1, there can be several spaced pairs of cuts 6 in an expandable panel having a first transverse spacing distance 25 between the pairs. On a left side of the first longitudinal line of cuts 20 there is a expandable panel left side 23 and on the right side of the second longitudinal line of cuts 21 there is a right expandable panel side 24.

The first longitudinal line of cuts of longitudinal line of cuts 20 or 21 each comprise spaced cuts 6 of one selected shape whereby each cut 6 is separated from a co-linear cut 6 by a longitudinal uncut spacing distance 26 which has a length extent type dimension parallel with a length dimension which includes at least a part of living hinge 8, with a line of spaced cuts 6 forming a first pattern. The cuts 6 of each longitudinal line of cuts 20 and 21 are closer to each other, than the distance between pairs of longitudinal line of cuts 20, 21 to another pair of longitudinal line of cuts of cuts 20, 21.

The second longitudinal line of cuts 21 is spaced by a second transverse spacing distance 28 to the immediately adjacent first longitudinal line of cuts 20 whereby the second longitudinal line of cuts 21 is closer to the first longitudinal line of cuts 20 in one pair by second transverse spacing distance 28, than the first transverse spacing distance 25 in an adjacent pair or third longitudinal cut line. Second longitudinal line of cuts 21 are formed of spaced cuts 6 similar to the first longitudinal line of cuts 20 having a similar longitudinal uncut spacing longitudinal distance 26 forming a second pattern.

The first and second longitudinal line of cuts 20 and 21 are oriented substantially in parallel with each other such that they intermesh with each other in a spaced offset mirror image relationship. Each cut 6 comprises a continuous cut of any shape such as for example, straight and/or curved cuts which at least include a base portion 30 and end portion 31. The end portion 31 extends at an acute angle from the base portion 31 to form a recess 32 there against. The end portion 31 of longitudinal cut line 20 is shaped and oriented to extend closer laterally to an immediately adjacent end portion 31 of the immediately adjacent second longitudinal cut line 21. During intermeshing the recesses 32 of each longitudinal line of cuts 20 and 21 face each other. The spaced intermeshing is caused by the end portion 31 of one longitudinal line of cuts 20 being closer to the base portion 30 of the other adjacent longitudinal line of cuts 21 by a third transverse spacing distance 33 at a narrow portion. This third transverse spacing distance 33 between cuts 6 provides some of the means for each living hinge 8 to form and work (rotate) as intended.

Figure 2:
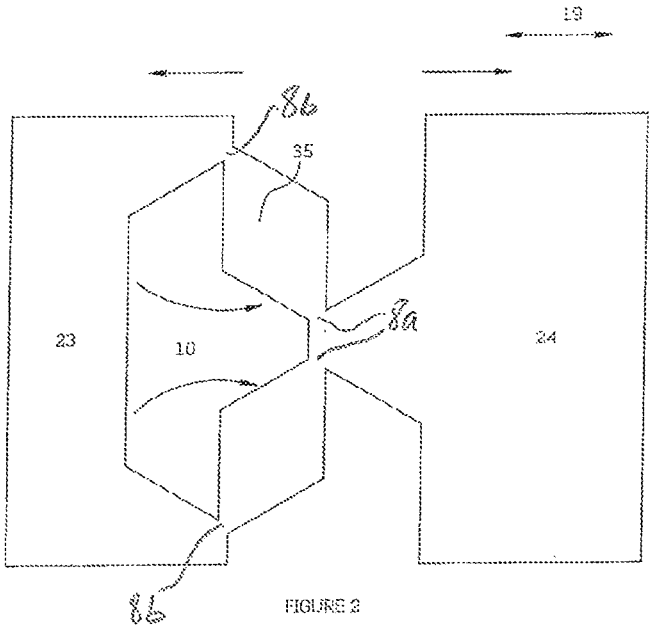
Figure 3:
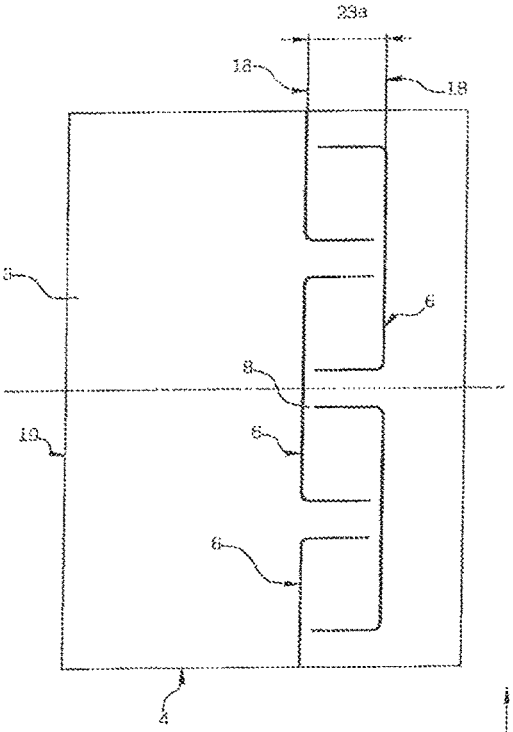

In the retracted or closed state, the expandable panel has at least one pair of cuts 6 forming the first longitudinal line of cuts 20 and also at least one pair of cuts 6 forming the second longitudinal line of cuts 21. In its simplest form ie shortest expandable panel end to end, and narrowest side to side as seen in FIGS. 1 and 2, there is one of longitudinal cut 6 in first longitudinal line of cuts 20 and the other longitudinal line of cuts 21 has two spaced cuts 6 which together form two islands or bridging members 35 on either side of one aperture 10 with four living hinges 8 with one living hinge 8 on each side of each bridging member 35. In this example the cut 6 is shown as been made up of one angled trough cross section and the two spaced cuts 6 can be angle L shaped forming semi boat shaped apertures 10 as seen in FIGS. 1-2. Other options include different shaped cuts 6 such as square trough as in FIG. 3-5 and angled (FIGS. 6, 7) or curved trough (FIG. 8) and half curve.

Each cut 6 at the end of the longitudinal direction (the end edge 4) is usually half the length of one of the cuts 6 not at the end of the longitudinal direction of a panel.

When the expandable panel 1 is stretched in the expanded state or mode, one longitudinal line of cuts 20 or 21 is pulled laterally (ie transverse to the length or longitudinal direction) with respect to the other line 21 or 20 whereby each cut out 6 having cut side faces 16 will be forced apart from each other about the living hinge 8, forming one aperture 10 there between the cut side faces 16 (which includes a shape determined by the shape, orientation and spacing of the cuts 6 eg a polygon or curved shapes) and a bridging member 35 (which has a shape also being polygonal or curved) also determined by the shape, orientation and spacing of the cuts 6 in one longitudinal line of cuts with respect to the other longitudinal line of cuts.

Therefore each living hinge 8 is formed from where the third spacing 33 intersects with second spacing 26 which comprises uncut portions of the panel. Initially the expandable panel is said to a retracted state ie the expandable panel is substantially flat. The intersection of longitudinal spacing 26 and transverse spacing 33, is such that it is less in dimension than any other dimension between each adjacent longitudinal line of cuts 20, 21 of each pair of cuts 6 which then enables each bridging member 35 and living hinge 8 to rotate about at least one plane (eg horizontal and/or vertical) together or singularly ie vertical and horizontal plane to cause the aperture 10 to be formed and enlarged while the bridging member 35 to able to separate out, rotates to cause the first longitudinal line of cuts 20 to be separated further from the second longitudinal line of cuts 21 whereby the distance between longitudinal line of cuts 20, 21 goes from spacing distance 23*a* to an enlarged spacing distance 37 with the expandable panel being flat again. Therefore the expandable panel is extended by distance 37 minus the distance 23*a* which equates to the gap between the side edges 16 of each expandable panel side.

When the panel is expanded the bridging member 35 rotates about the living hinges 8 forcing abutting side walls 16 to move from almost abutting relationship (ie minimized aperture 10 at almost zero area) to a spaced relationship forming apertures 10 there between which will extend to a maximum area. When retracting or closing the panels the same thing occurs but in reverse with the area of apertures 10 decreasing in area to nothing or almost nothing.

Therefore in a curved or substantially straight at least longitudinal line of cuts 20, 21, we have cuts 6, living hinge 8-bridging member 35-living hinge 8-bridging member 35 with apertures 10 on each side. Also when the expandable panel is expanded, the apertures 10 increase in area from zero or almost nothing and/or volume while each bridging member 35 rotates out of the horizontal plane temporarily and vertically with the rest of the adjoining side expandable panel portion moving vertically and horizontally, to reach a maximum living hinge rotation angle with the maximum area or volume of aperture 10 thereby the expandable panel being extended by a distance equal to a spacing 37 between longitudinal line of cuts 20 and 21 when expanded, minus the spacing between longitudinal line of cuts 20, 21 when retracted.

Figure 5:
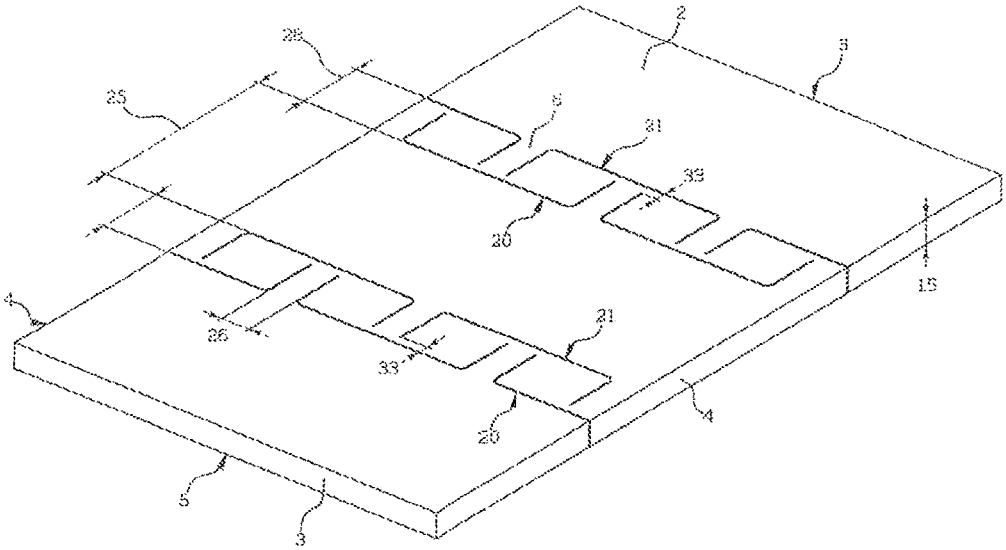
Figure 4:
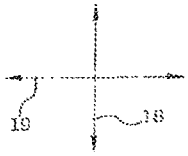
Figure 4:
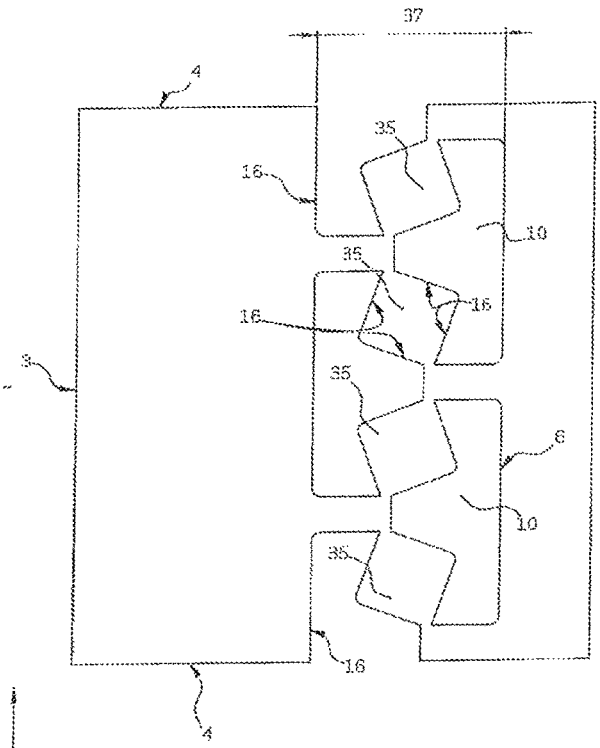
Figure 6:
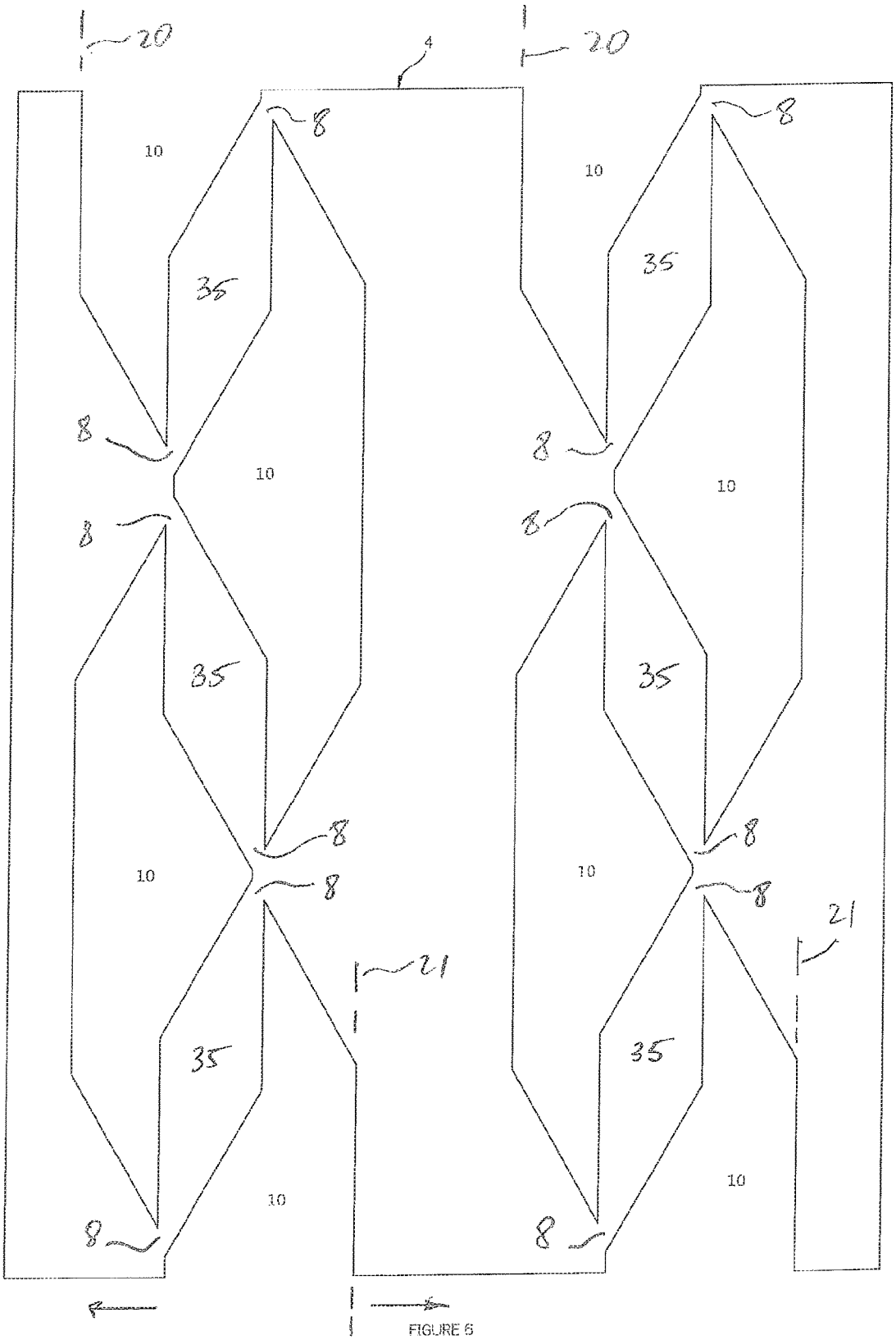
Figure 7:
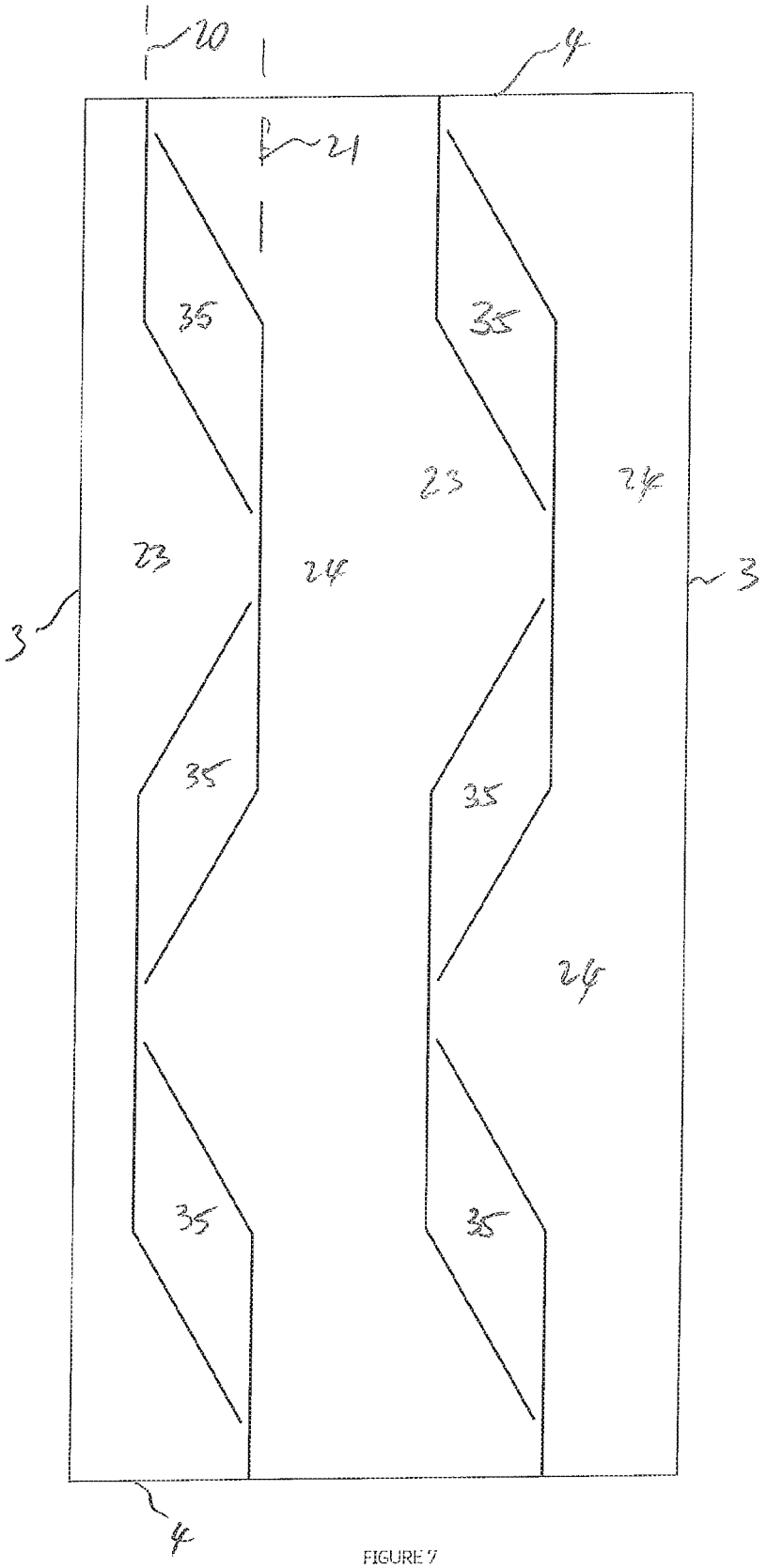

As shown in FIGS. 4-6 the orientation of the longitudinal line of cuts 20 or 21 can be straight or angled or the cuts 6 can be straight or curved to form curved three side apertures 10 and curved bridging bodies 35.

There are many options for the shape of each actual cut 6, and their pattern in a line, the most basic of which is shown in FIGS. 1 and 2. As shown for example in FIGS. 3 and 4, one driving geometry is the relationship between the length of a joint L (angled distance from living hinge 8 to living hinge 8 or another can be the distance from the ends of the end portion 31 of one cut 6 in one longitudinal line of cuts 20 to an end of an end portion 31 of a cut 6 in the other longitudinal line of cuts 21) and an included angle (A). In yet another option in describing the driving geometry to enable the panel to at least expand, can be the relationship between the angled distance between living hinges 8 on one bridging member 35 and an imaginary centre line 45 being parallel between lines 20 and 21 or an imaginary longitudinal line 45 almost parallel and between pairs of adjacent cuts 6 on each side of the panel.

In this example of FIG. 5, the expandable panel or sheet has at least one natural state of equilibrium, open or stretched or expanded. In another option, the natural state can include or be, a closed or retracted state. The cut 6 resists the expandable panel existing in any other state as the joint or hinge will tolerate the compression required to change between states, but will essentially act as a spring 'popping' the expandable panel section open forming each aperture 10 or closed with no aperture 10.

In its simplest form as seen in FIGS. 1 and 2, it is the rotation of at least two bridging members 35 spanning the sides of the expandable panel about four living hinges 8 (including an inner pair of living hinges 8*a* and an outer pair of living hinges 8*b*), which causes the inner pair of living hinges 8*a* to rotate and translate out of the horizontal plane more so than the outer pair of living hinges 8*b* (which rotate only—stay in one position) whereby each bridging member 35 rotates about the outer pair of living hinges 8*b* while one side 24 of the expandable panel moves laterally away from the other side 23.

Each bridging member 35 rotates about the living hinges 8, at a set angle depending on the length dimension L between living hinges 8 of each bridging member (eg approximately 90 degrees) when the expandable panel is expanded or retracted which causes the apertures 10 to increase in area to a maximum when the expandable panel is fully expanded or be no area when fully retracted. Each bridging member 35 has a diagonal distance L extending between living hinges 8 which is proportional to a rotation angle A of the bridging member 35.

As shown in FIGS. 8-16 there are several more examples of the expandable panel having different shaped cuts 6 forming longitudinal lines of cuts 20, and 21. The same components as in the other examples of expandable panels of the present invention such as the bridging members 35 movably or rotationally joined by living hinges 8 with the other reference numbers to edges, sides 23, 24, side edges 3 and ends 4 are also been included. The longitudinal lines of cuts 20 and 21 are relatively easy to see with straight cuts 6 but are harder to define when the cuts 6 are curved as in FIGS. 10, 11, 12 and 14. Each expanded or opened panels is also shown with directional movement arrows.

There is also disclosed an example of a method of manufacturing the expandable panel as disclosed in this specification, including

- Providing a expandable panel made of a material able to form living hinges 8 eg ductile material which can be a textile, plastics metal or wood;
- Positioning the expandable panel in a cutting apparatus or manufacturing apparatus including cutting and moulding;
- Cutting in a specific pattern to form pairs of longitudinal cut lines 20, 21 with bridging members 35 being formed between living hinges 8.

Some Optional Advantages a) Able to transport as a flat pack of minimal width or length
b) Less storage space required when expandable panel is retracted
c) Less material wastage or offcuts
d) Less transport space required when expandable panel is retracted
e) Less likely to be damaged during transport and storage
f) Simple manufacturing method
g) Modest cost of manufacture
h) Variety of expandable panel shapes are possible
i) Variety of panels cut shapes and patterns are possible
j) Curved or straight expandable panel cuts can be used
k) Expandable panel is not forcably stretched/expanded or deformed during use
l) Expandable panel is expanded to remain as flat planar expandable panel when extended or retracted
m) Expanded or retracted expandable panel shape each formed as a stable shape n) Expandable panel can be easily expanded or retracted
o) Different shaped expandable panel cuts are possible
p) Flat or curved expandable panel shapes are possible
q) Expandable panel can be expanded along its length or its width
r) Expanding and retracting uses living hinges
s) Expanding and retracting is easy to operate
t) Expanding and retracting is able to be repeated
u) Expanded shape able to allow air circulation there through
v) Any type of expandable panel can be cut according to the manufacturing method
w) Panels such as partition, screeds or panels and acoustic panels can be used
x) Present invention can be used for a variety uses Variations Throughout the description of this specification, the word "comprise" and variations of that word such as "comprising" and "comprises", are not intended to exclude other additives, components, integers or steps. Living hinges 8 can also be referred to as any living hinge or joint that is able to rotate and or bend/deform without breaking over a certain number cycles of rotation eg minimally one cycle of bending or expanding the panel is all that is needed. The intermeshing of the longitudinal cut lines are intermeshed in a spaced offset type relationship being almost parallel in mirror images with each other as a pair of lines which enable there to be bridging members 35 which use living hinges 8 to span there between each pair of lines 20 and 21. Even the mirror images is not strictly requires as long at the weakened or living hinges are formed to allow rotation.

The expandable panel is shown as being rectangular in shape but equally any other shape is possible such as square, round, circular, angled, any geometric shape or pattern or combination as required. As disclosed in this specification, there is a minimum requirement to allow a expandable panel to expand and/or retract but equally the degree or amount of expansion can be varied. In an expandable panel 1 having multiple pairs of longitudinal cut lines, expansion and/or retraction can be selectively applied minimally to just one pair or to more than one pair of longitudinal line of cuts. Additionally the amount of expansion and or retraction along a pair of longitudinal line of cuts can also be varied if desired or if necessary.

The cuts 6 can also be formed of any shape or pattern that at least allows the expandable panel to be expanded to form the expandable panel shape and aperture 7 shape as required. Cuts 6 can be called slits or slices. The cut side faces 16 can be almost parallel with each other and with the side edges 3 and end edges 4, but not necessarily so—if required they can be angled. Cuts 6 and the cut side faces 16 can be planar faced, contoured, curved or angled. If the expandable panel is not constrained, the rotation of a body of each bridging member 8 can be acting in two planes (possibly mainly in one plane) or can be in a combination of two planes. If the expandable panel is constrained in one plane eg horizontal plane or the plane parallel with the faces of the panel, then each body of bridging member 35 is able to rotate just in that plane.

Furthermore, the cuts 6 of each longitudinal line of cuts 20, 21 in the longitudinal direction 18 on each side of an alternating pattern, can be U shaped, L shaped, splayed U-shape (see FIGS. 6 and 7) curved (see FIG. 8), S shaped or Z shaped and any combination thereof with an end portion of each longitudinal line of cuts 20, 21 being but not limited to a half of the preceding cut 6 shapes—also as shown in the figures. In yet another variation the longitudinal line of cuts 20, 21 on each need not be offset mirror images of each other but can be different but at least face each other in a non-touching intermeshing formation, to form the living hinges 8 there between the expandable panel sides and bridging members 35. Furthermore the lines of cuts 6 and lines 20, 21 also do need to be straight and one line, with term 'longitudinal' merely indicating a general line or general direction.

Figure 8:
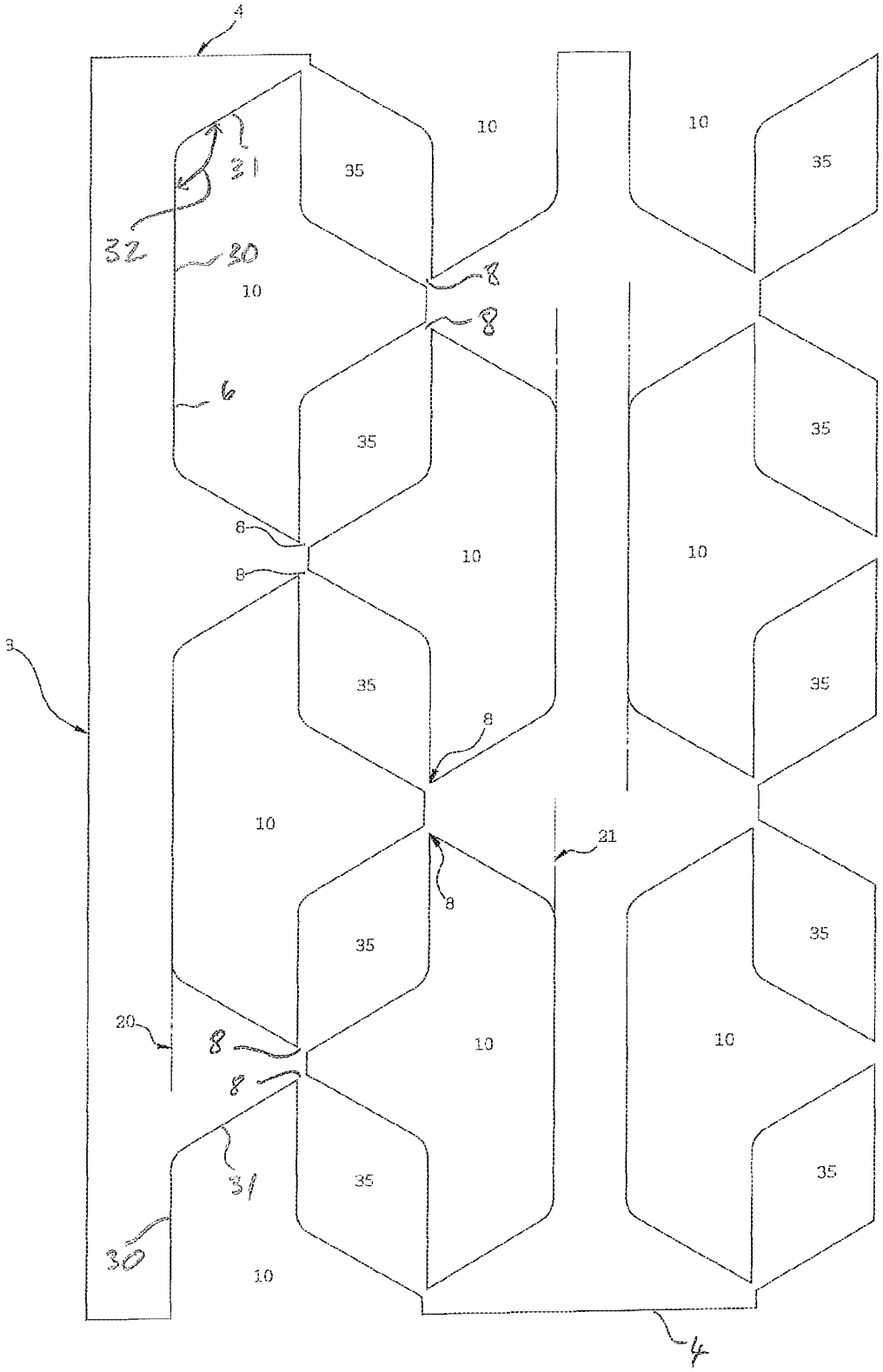
Figure 9:
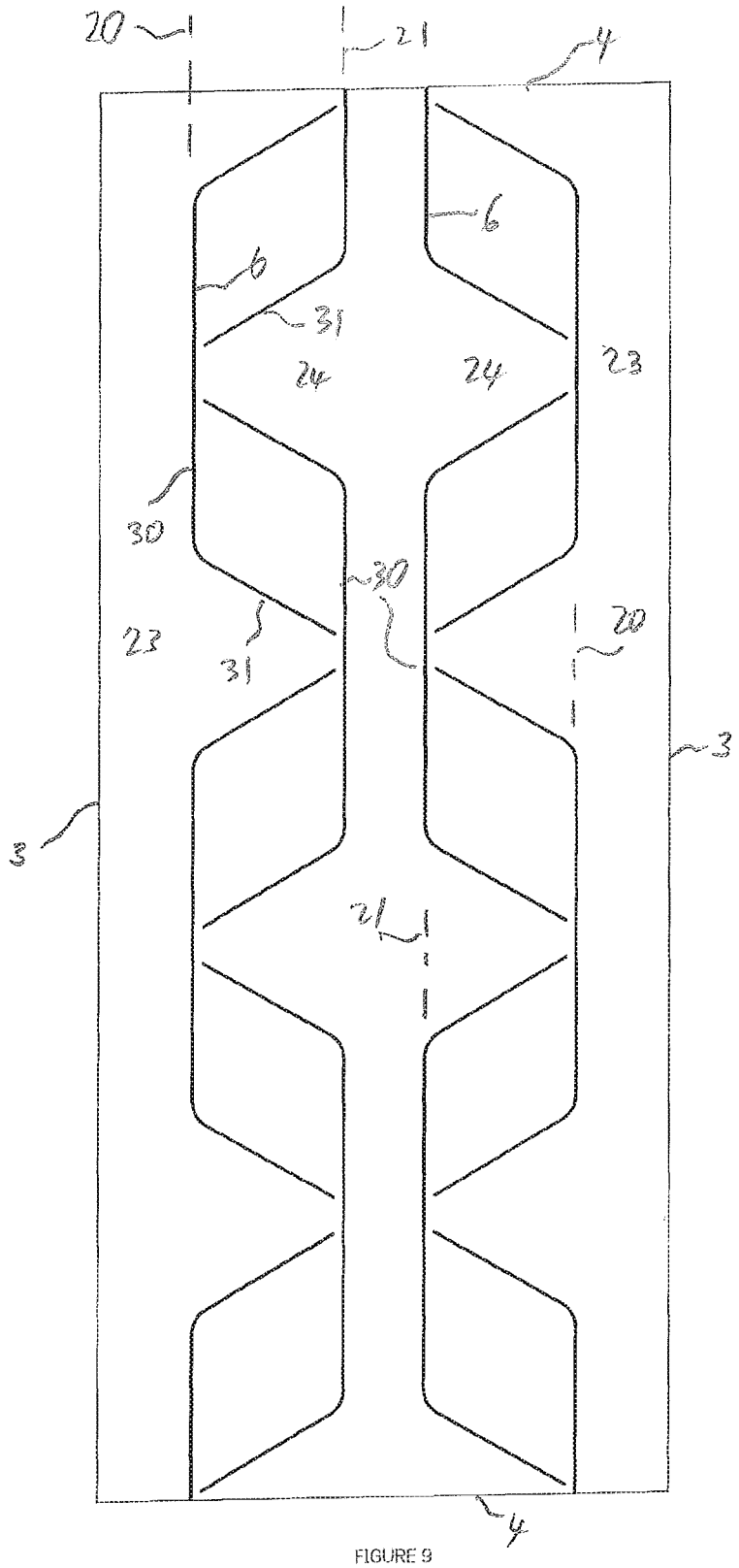
Figure 10:
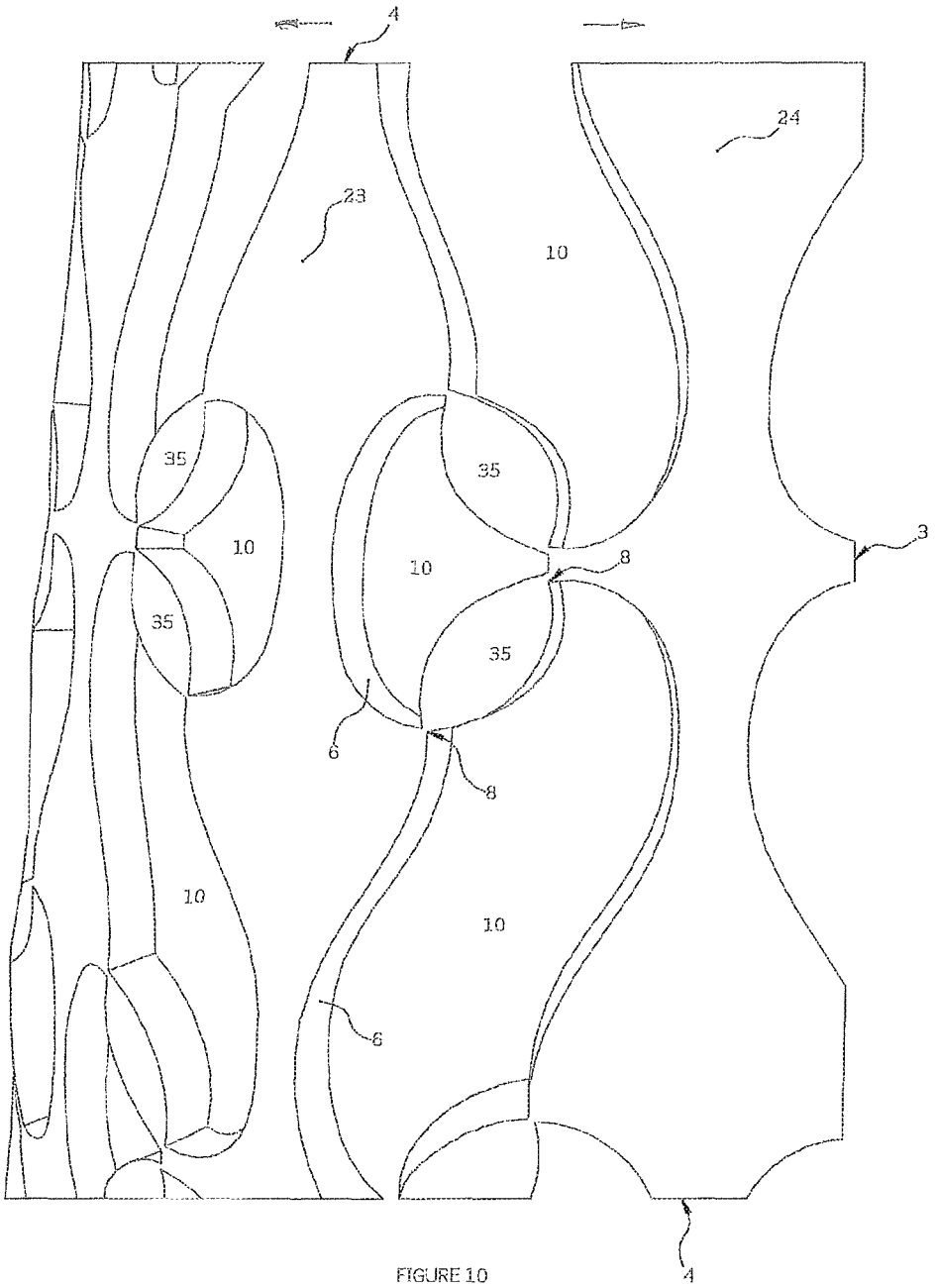
Figure 11:
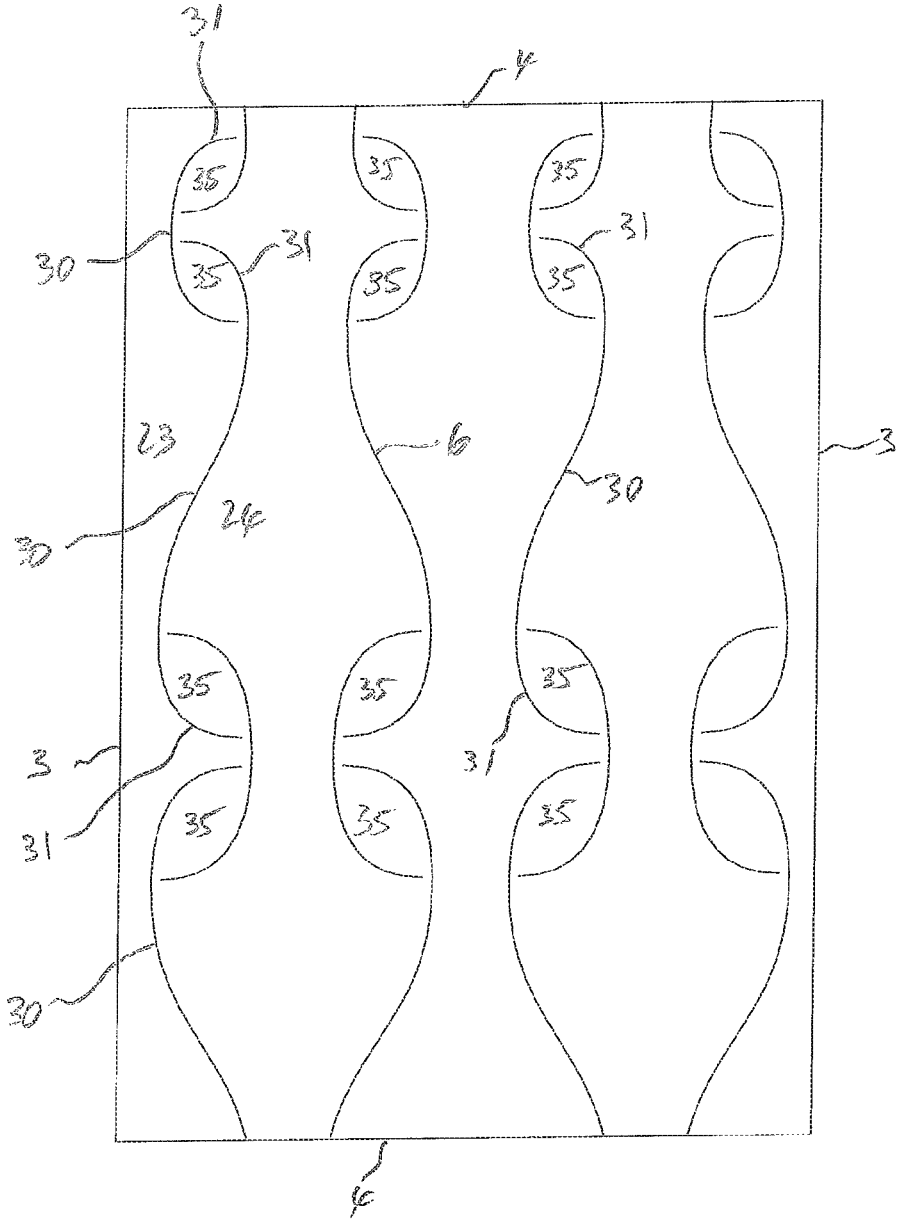
Figure 12:
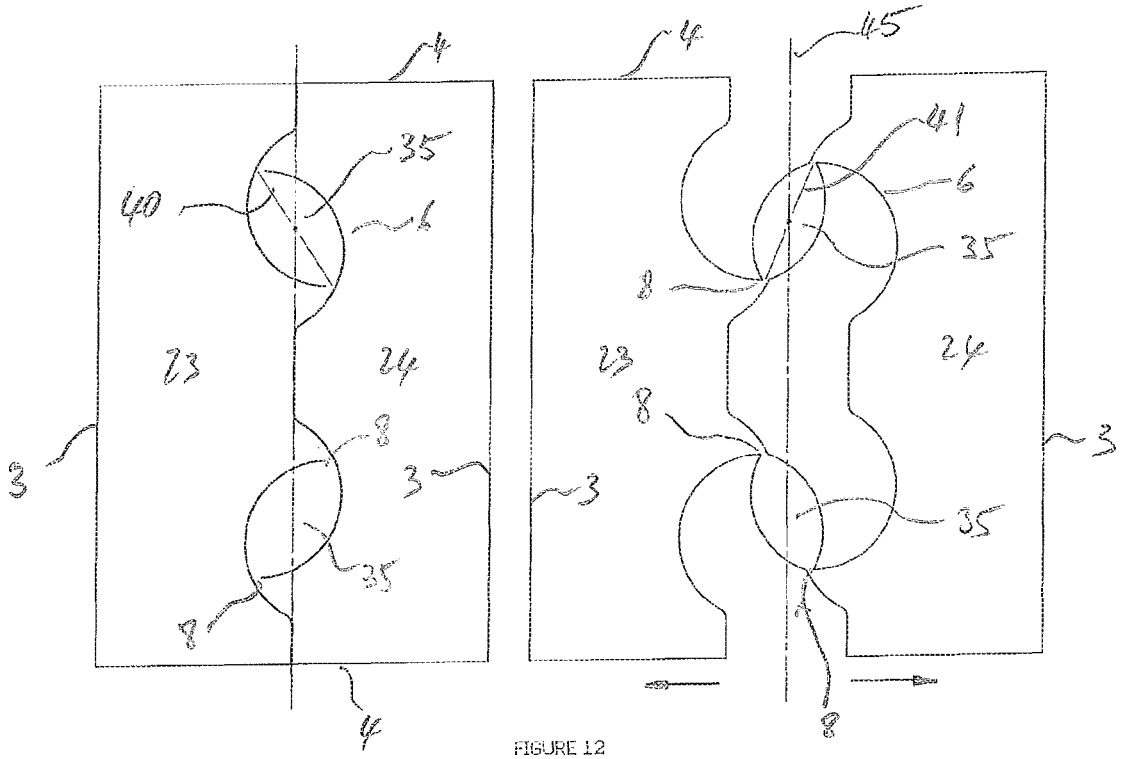
Figure 13:
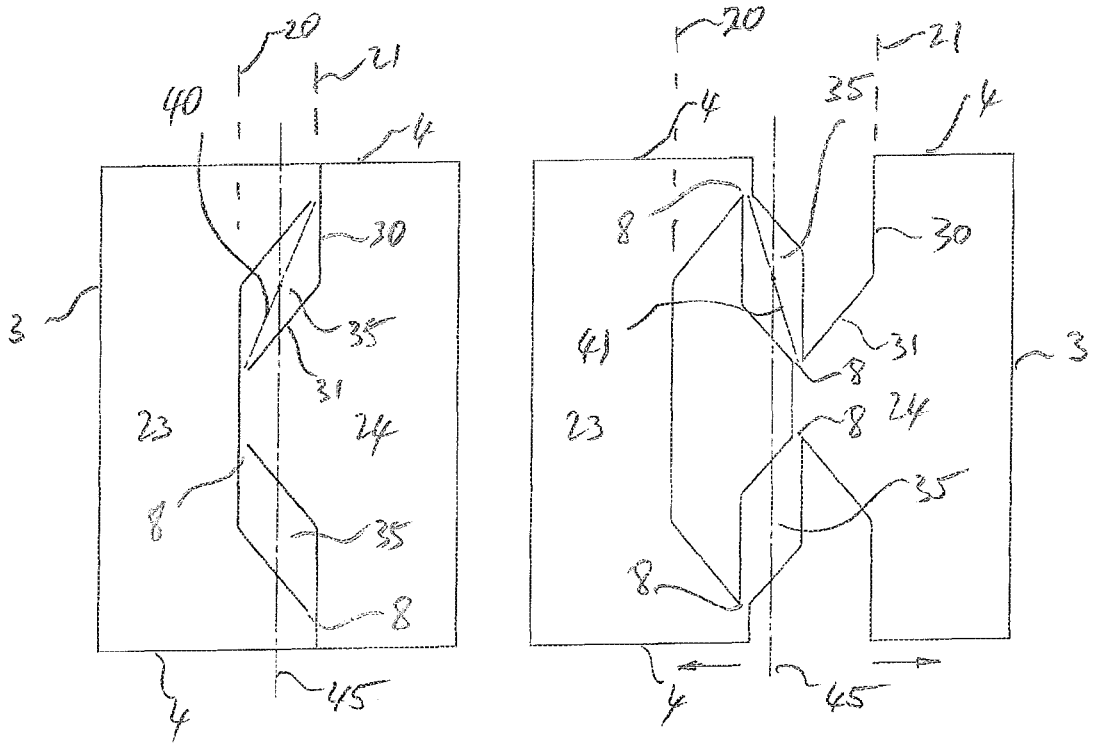
Figure 14:
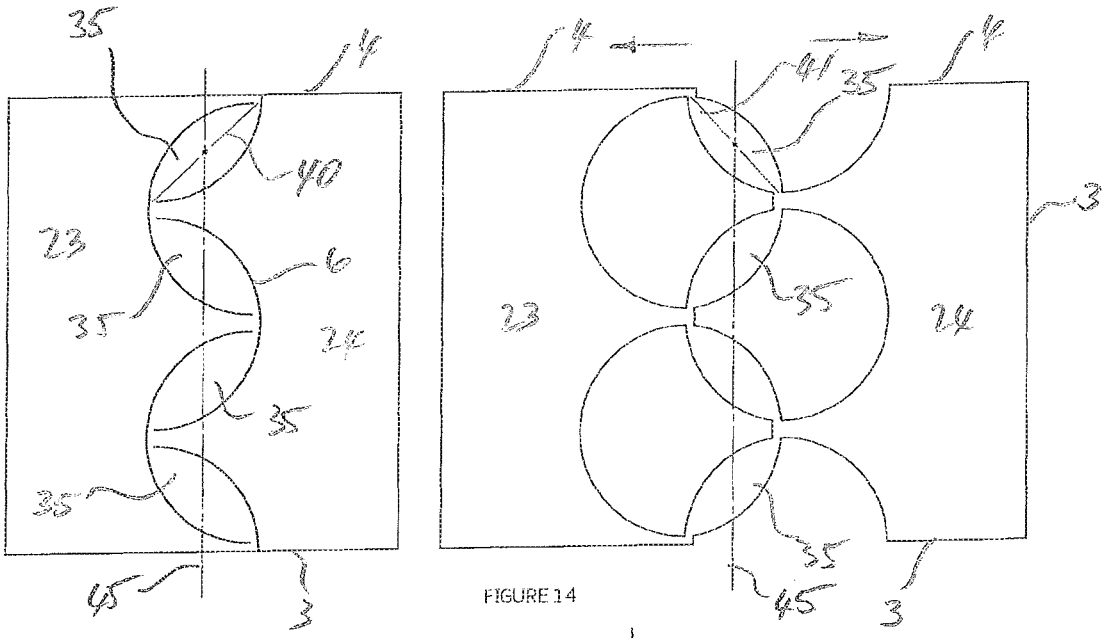
Figure 15:
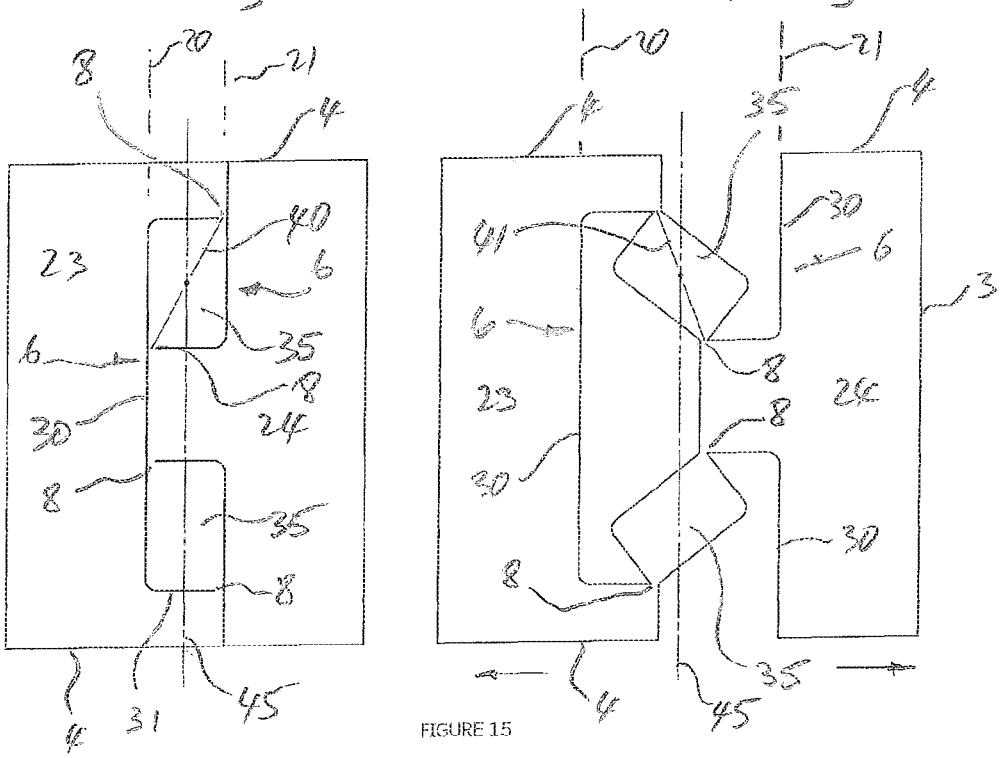
Figure 16:
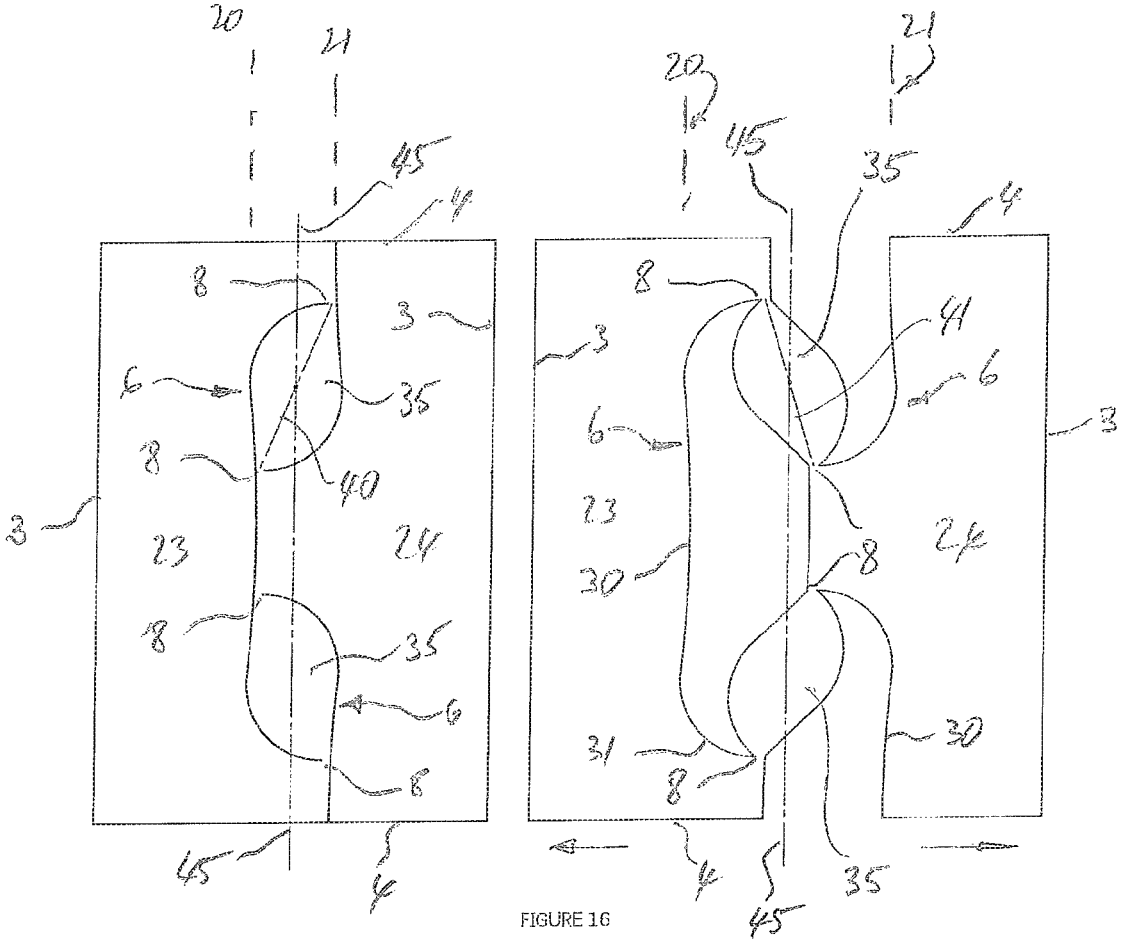

Apertures 10 can be any suitable shape depending on the configuration of the cuts or lines such as for example be loosely described as boat shaped with straight and angle cut lines or be curved as seen in FIG. 8. The apertures 10 on each side of the bridging members 35 can the same shape, be different or larger on one side or be a different shape. The bridging members 35 like the apertures 10 can be an shaped depending on the cuts and or lines and can be for example be loosely described as diamond shaped or rectangular shaped as seen in FIGS. 1-7 or be oval shaped as seen in FIG. 8. By boat shaped it has a base larger than a top part which looks like a simple boat.

The figures only show one pair of parallel longitudinal line of cuts 20, 21 of cuts whereas it is equally possible to have many lines of these pair of cuts. Each cut 6 for each longitudinal line of cuts 20 and 21 can be formed of the same cut but in some instances, each cut can be different in the one longitudinal line of cuts. Each pair of longitudinal line of cuts 20, 21 are shown as being parallel to each other but also the pairs of lines do not to be exactly parallel with each other or the lines can be curved or splayed somewhat. The panels can be fabricated from any material that enables the panel to be at least pulled apart opened or expanded in one state. The material can be a ductile material, a fibre material, timber or metal or any suitable combination that allows at least expansion by rotating a bridging member about living hinges to create apertures 10 there between. Other options include being able to retract or have a retracting state which may limit the material able to do both states our just one.

As a pattern, the apertures 10 alternate on each side of the longitudinal line of cuts 20, 21 with the bridging members 35 spanning in between, being rotated in opposite directions. Therefore as a minimum there can be an expandable panel with say two longitudinal line of cuts forming sides of the expandable panel and ends, comprising one centrally located cut 6 as one longitudinal line of cuts 20 on one side, with two cuts 6 as the longitudinal line of cuts 21 immediately opposite and intermeshing but close enough to form two bridging members spanning between the sides with one aperture 10 on one side of the bridging members 35 and two apertures 10 on the other side of the bridging members 35.

The distance between adjacent longitudinal line of cuts 20 and 21 ie distance 28 can be greater than, less than or equal to, to the distance between each pair (20 and 21) ie distance 25. In general all of the distances between the cuts 6 angular or transverse or longitudinally, can be varied to be uniform or random in any combination etc. Terms like 'length; and 'width', and 'longitudinal' or 'transverse' can be interchanged with their relative positioning being more important with regard to the cuts 6 of longitudinal line of cuts 20 or 21, being more important. The direction of the expansion and retraction is dependent on the orientation of the longitudinal line of cuts which such direction is at right angles to the length of the cuts 6 and longitudinal line of cuts, which means the direction of expansion and retraction can be towards the sides or end of the expandable panel.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

The expandable panel of the present invention can be used as cladding, interior & exterior, both decorative & structural panels, ceiling structures, and claddings, decorative elements, furniture components, acoustic elements, light diffusion, sound diffusion, sportswear, fashion textile adaption, clothing applications, netting, decoration and/or safety, horticulture, gardening, nano technology, adapted for health care uses, artificial tissue, casts and braces, impact adsorption, impact isolation, space exploration, flow control, structural building elements, light weight partitioning, internal framing and temporary structures/disaster relief.

It will also be understood that where a product, method or process as herein described or claimed and that is sold incomplete, as individual components, or as a "kit of Parts", that such exploitation will fall within the ambit of the invention.

These and other features and characteristics of the present invention, as well as the method of operation and functions of the related elements of structures and the combination of parts and economics of manufacture, will become more apparent upon consideration of the following description with reference to the accompanying drawings, all of which form part of this specification, wherein like reference numerals designate corresponding parts in the various figures.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

For purposes of the description hereinafter, the terms "upper", "lower", "right", "left", "vertical", "horizontal", "top", "bottom", "lateral", "longitudinal", "side", "front", "rear" and derivatives thereof shall relate to the invention as it is oriented in the drawing figures. However it is to be understood that the invention may assume various alternative variations, except where expressly specified to the contrary. It is also to be understood that the specific devices illustrated in the attached drawings, and described in the following specification are simply exemplary embodiments of the invention. Hence specific dimensions and other physical characteristics related to the embodiments disclosed herein are not to be considered as limiting.

What we claim is:

1. An expandable panel constructed to at least expand in at least one direction, comprising:

a panel having a front face and a rear face, bordered by side edges, end edges, a thickness dimension extending between the front and rear faces, and a plurality of cuts extending from the front face to the rear face or from the rear to the front face, the plurality of cuts forming bridging members between living hinges, and the plurality of cuts having cut side faces therebetween, wherein the plurality of cuts are elongate and extend in a spaced longitudinal manner and comprise at least one first cut forming a first side of the expandable panel located on a first side of the first cut, and at least two second cuts located on a second side of the expandable panel, the first cut on the first side and the second cuts on the second side together forming at least one pair of lines being substantially parallel, offset mirror images of each other and being intermeshed but not touching, a distance between the end edges defining a length in a longitudinal direction, and a distance between the side edges defining a width in a transverse direction, the first and second cuts being oriented in the longitudinal direction, and each of the first and second cuts comprises at least a base portion and an end portion, where the end portion extends at an angle with respect to the base portion forming a recess therebetween, with the base portion being oriented in one of the first and second cuts and the end portion extending at an acute angle with respect to a line of the base portion such that the first cut is adjacent the second cuts, and the recesses of both the first cut and the second cuts face each other forming movable bridging members between the living hinges which allow the expandable panel to exist in at least an expanded state where the first and second sides of the expandable panel can be pulled or expanded transversely apart to expand the expandable panel such that the bridging members are rotated about the living hinges forming at least one expandable panel space aperture between the first and second cuts on a first side of one bridging member and at least two apertures on an other second side of two bridging members, such that the width or length dimension of the expandable panel is able to be at least increased transverse to a length of the first and second cuts wherein the expanded state and a retracted state of the expandable panel are both stable states such that the expandable panel pops into each of the expanded and retracted states as required, wherein expansion of the expandable panel is caused by rotation of at least two of the bridging members about at least four of the living hinges which include an inner pair of the living hinges and an outer pair of the living hinges, which such rotation causes the inner pair of the living hinges to at least move and rotate, and the outer pair of the living hinges rotates only by staying in one position and vice versa, whereby each bridging member rotates about the outer pair of the living hinges while one of the first side and the second side of the expandable panel moves laterally away from the other of the first side and the second side.

2. The expandable panel as claimed in claim 1, wherein each bridging member spans between the sides of the expandable panel between the first and second cuts on each side, thereby providing one aperture on one side of the bridging members and two apertures on the other side of the bridging members and each bridging member rotates about the living hinges, when the expandable panel is expanded whereby the apertures increase in area to a maximum when the expandable panel is expanded.

3. The expandable panel as claimed in claim 2, wherein a first longitudinal cut line is formed by at least two first cuts in a line spaced from one another, and a second longitudinal cut line is formed by the second cuts comprising at least one pair of second cuts in a line spaced from one another, and wherein the expandable panel is also able to retract in a same manner as for expanding but in an opposite direction whereby the areas of the apertures are minimized.

4. The expandable panel as claimed in claim 3, wherein a direction of the expansion is dependent on an orientation of the longitudinal cut lines, where said direction is oriented at right angles to the length of the first and second cuts and the longitudinal cut lines, such that the direction of expansion is directed towards the sides or ends of the expandable panel whereby at least one length or width dimension of the expandable panel is not changed when the expandable panel is expanded.

5. The expandable panel as claimed in claim 4, wherein one of the first or second cuts at the end edge of the first or second longitudinal cut lines of the expandable panel is formed of a different shape to the other of the first or second cuts not at the end edge of the expandable panel, wherein the the one of the first or second cuts at the end edge of the longitudinal cut lines is half length of the other of the first or second cuts not at the end of the longitudinal cut lines.

6. The expandable panel as claimed in claim 5, wherein the one of the first or second cuts at the end of the longitudinal cut line of the expandable panel is L shaped, and another of the first and second cuts not in the middle of the panel is square U shaped, whereby an upright portion of the L forms the base portion and a base of the U shape is the base portion which are oriented in a line forming one longitudinal cut line.

7. The expandable panel as claimed in claim 6, wherein the end portion of either of the first and second cuts includes a shape comprising a distal end that is distal to the base portion, wherein the distal end of the end portion of the first longitudinal cut line is transversely closer to the base portion of the second longitudinal cut line than a transverse distance between the end portion of the first longitudinal cut line to the end portion of the second longitudinal cut line, the first and second cuts of each longitudinal line of cuts being closer to each other than the distance between pairs of the first and second longitudinal cut lines.

8. The expandable panel as claimed in claim 7, wherein a driving geometry of the expandable panel to enable expansion and retraction is a relationship between a length of one joint L as defined as an angled distance from a distal end of the end portion of the first cut in the first longitudinal cut line to a distal end of an end portion of the second cut in the second longitudinal line forming a distance between the living hinges and an included angle (A) which relates to the angle of rotation of each bridging member.

9. The expandable panel as claimed in claim 8, wherein each of the first and second cuts resists existing in any state other than said expanded state and said retracted state, as the hinge will tolerate compression required to change between the expanded and retracted states, but will act like a spring by 'popping' the expandable panel open or closed, each of the first and second cuts forming a joint which resists the expandable panel existing in any state other than said expanded state and said retracted state, as the joint will tolerate the compression required to change between the expanded and retracted states, but will operate as a spring 'popping' the expandable panel section open forming each aperture or closed with no aperture.

10. The expandable panel as claimed in claim 9, wherein each living hinge is located between an end of the first cut of the first longitudinal cut line and a base portion of the adjacent second cut of the second longitudinal cut line, whereby when two living hinges are located at opposite sides of the longitudinal cut lines, then one bridging member is formed there between which is able to rotate by angle (A) when the expandable panel is expanded or retracted.

11. The expandable panel as claimed in claim 10, wherein a longitudinal distance as defined from end edges from the distal end of one end portion in the first longitudinal cut line to the adjacent distal end of the another end portion in the same first longitudinal cut line is greater than the transverse distance between from the distal end of the end portion of the first longitudinal cut line to the base portion of the first and second cuts of the second longitudinal cut line.

12. The expandable panel as claimed in claim 11, wherein the bridging portion is diamond shaped, oval shaped, or rectangular shaped.

13. The expandable panel as claimed in claim 12, wherein each cut of the first and second cuts comprises an angled shape or curved shape and can be selected from the following shapes of U shaped or splayed U shape, S shaped or Z shaped in any combination.

14. The expandable panel as claimed in claim 13, wherein the first and second longitudinal cut include a plurality of spaced first and second cuts in each longitudinal cut line, wherein the first and second longitudinal cut lines include spaced straight lines, spaced angled lines, straight and angled lines, or spaced curved lines.

15. The expandable panel as claimed in claim 14, wherein when the expandable panel is expanded, the area of the aperture is larger than the area of the bridging member.

16. The expandable panel as claimed in claim 15, wherein each aperture is boat shaped with straight and angled cut lines, or is boat shaped with curved cut lines.

17. The expandable panel as claimed in claim 16, wherein the apertures on one side of the bridging members:

are similar in area to apertures on an other side of the bridging members, are larger in area than the apertures on the other side of the bridging members, or are different in shape to the apertures on the other side of the bridging members.

18. The expandable panel as claimed in claim 17, wherein during expansion each bridging member has a body that rotates having a major portion of that body which rotates about a horizontal plane that is a same plane as the faces of the panel, with a smaller portion of the body rotating vertically.

19. The expandable panel as claimed in claim 18, wherein each living hinge is defined and formed by a transverse distance located between the end of the first cut on the first longitudinal cut line extending to the base portion of the second cut of the second longitudinal cut line, and a longitudinal distance as defined between an end of the end portion of cuts in one of the first or second longitudinal cut lines wherein the transverse distance is less than the longitudinal distance.

20. The expandable panel as claimed in claim 19, wherein each bridging member has a diagonal distance L extending between living hinges which is proportional to a rotation angle (A) of the bridging member, and when the panel is expanded the bridging member rotates about the living hinges forcing abutting side walls to move from an almost abutting relationship to a spaced relationship forming apertures therebetween which extends to a maximum area.

* * * * *